US009547980B2

(12) United States Patent
Chen et al.

(10) Patent No.: US 9,547,980 B2
(45) Date of Patent: Jan. 17, 2017

(54) SMART GATEWAY, SMART HOME SYSTEM AND SMART CONTROLLING METHOD THEREOF

(71) Applicant: Shenzhen Airdrawing Technology Sercice Co., Ltd, Shenzhen (CN)

(72) Inventors: Te-Sheng Chen, New Taipei (TW); Xiao-Guang Li, Shenzhen (CN); Kuan-Hong Hsieh, New Taipei (TW); Yun Xiao, Shenzhen (CN); Shang-Hui Pi, Shenzhen (CN)

(73) Assignee: Shenzhen Airdrawing Technology Service Co., Ltd, Shenzhen (CN)

( * ) Notice: Subject to any disclaimer, the term of this patent is extended or adjusted under 35 U.S.C. 154(b) by 448 days.

(21) Appl. No.: 14/066,704

(22) Filed: Oct. 30, 2013

(65) Prior Publication Data

US 2014/0118120 A1 May 1, 2014

(30) Foreign Application Priority Data

Oct. 31, 2012 (CN) ..... 2012 1 04269465

(51) Int. Cl.
*G08C 17/02* (2006.01)
*G08C 23/04* (2006.01)

(52) U.S. Cl.
CPC ..... *G08C 17/02* (2013.01); *G08C 23/04* (2013.01); *G08C 2201/40* (2013.01); *G08C 2201/42* (2013.01); *G08C 2201/93* (2013.01)

(58) Field of Classification Search
CPC . G08C 2201/93; G08C 2201/40; G08C 23/04; G08C 2201/42; G08C 17/02; G08C 17/00; G07C 9/00182; A63H 30/04; G05B 19/0426; E05F 15/0017; H04N 21/482; H04N 5/4401
USPC ..... 340/12.5
See application file for complete search history.

(56) References Cited

U.S. PATENT DOCUMENTS 5,028,919 A * 7/1991 Hidaka ..... G08C 19/28 340/12.28
5,444,499 A * 8/1995 Saitoh ..... H04N 5/44543 348/734
6,690,392 B1 * 2/2004 Wugoski ..... G06F 3/0481 715/704
6,771,182 B1 * 8/2004 Loh ..... G08C 23/04 340/12.28

(Continued)

FOREIGN PATENT DOCUMENTS

CN 101408754 A 4/2009
EP 2302605 A1 3/2011

(Continued)

*Primary Examiner* — An T Nguyen
(74) *Attorney, Agent, or Firm* — Zhigang Ma

(57) ABSTRACT

A smart controlling method applied to a smart home system for controlling a number of home appliances of the smart home system is able to learn the habits of the user in relation to the home appliances, deeming a control operation a habit when a certain controlling command is repeated for more than a predetermined number of times in a predetermined period. When the current certain condition value matches one of the habit certain conditions, the smart home system calls the corresponding habit controlling command to control the relative home appliance to execute the habitual operation. A smart gateway and a smart home system are also provided.

17 Claims, 18 Drawing Sheets

(56) References Cited

U.S. PATENT DOCUMENTS 8,350,697 B2 * 1/2013 Trundle ..... F24F 11/0086 340/539.26
8,955,003 B2 * 2/2015 Litvinov ..... H04N 5/4403 340/545.1
9,115,908 B2 * 8/2015 Shetty ..... F24F 11/006
2003/0112139 A1 * 6/2003 Matsui ..... G01V 8/10 340/500
2004/0034638 A1 * 2/2004 Brown ..... H04L 12/2602
2005/0093709 A1 * 5/2005 Franco, Jr. ..... A61B 5/1112 340/686.1
2007/0037522 A1 * 2/2007 Liu ..... G08C 17/02 455/68
2007/0173978 A1 * 7/2007 Fein ..... G05B 15/02 700/275
2007/0198663 A1 * 8/2007 Helander ..... H04L 41/0806 709/220
2007/0279247 A1 * 12/2007 Rye ..... G08C 17/02 340/13.25
2008/0098426 A1 * 4/2008 Candelore ..... H04N 5/4403 725/38
2008/0265799 A1 * 10/2008 Sibert ..... H05B 37/0245 315/292
2009/0195349 A1 * 8/2009 Frader-Thompson . G01D 4/002 340/3.1
2010/0289643 A1 * 11/2010 Trundle ..... F24F 11/0086 340/545.1
2011/0015797 A1 * 1/2011 Gilstrap ..... G05B 15/02 700/291
2011/0032423 A1 * 2/2011 Jing ..... H04L 12/282 348/552
2011/0040391 A1 * 2/2011 Noecker, Jr. ..... G05B 15/02 700/19
2011/0118857 A1 * 5/2011 Bodnar ..... G05B 13/026 700/47
2011/0313579 A1 * 12/2011 Ling ..... H04L 12/282 700/291
2012/0109399 A1 * 5/2012 Tran ..... H02J 3/14 700/296
2012/0146765 A1 * 6/2012 Koppelaar ..... G08C 17/02 340/5.61
2013/0139089 A1 * 5/2013 Cho ..... G06F 3/0484 715/771
2013/0166076 A1 * 6/2013 Karr ..... G05B 15/02 700/280
2013/0173064 A1 * 7/2013 Fadell ..... G05D 23/1902 700/276
2013/0297259 A1 * 11/2013 Tsao ..... G01D 4/004 702/188
2014/0115464 A1 * 4/2014 Shih ..... G06Q 10/109 715/716
2014/0118120 A1 * 5/2014 Chen ..... G08C 17/02 340/12.5
2014/0129006 A1 * 5/2014 Chen ..... G05B 15/02 700/90

FOREIGN PATENT DOCUMENTS

TW M284145 U 12/2005
TW M376989 U1 3/2010

* cited by examiner

| Region Code | Home Appliance/Device |
|---|---|
| ID of register controller 1 | ID of home appliance/device 1 |
| ID of register controller 1 | ID of home appliance/device 2 |
| ID of register controller 2 | ID of home appliance/device 3 |
| ID of register controller 2 | ID of home appliance/device 4 |
| ID of register controller 3 | ID of home appliance/device 5 |
| ... | ... |

FIG. 8

| Region Code | Home Appliance/Device |
|---|---|
| 01+ ID of register controller | ID of home appliance/device 1 |
| 01+ ID of register controller | ID of home appliance/device 2 |
| 02+ ID of register controller | ID of home appliance/device 3 |
| 02+ ID of register controller | ID of home appliance/device 4 |
| 03+ ID of register controller | ID of home appliance/device 5 |
| ... | ... |

FIG. 10

| | Habit State Parameter Value | Habit Controlling Command | |
|---|---|---|---|
| | | Operation Command | Home Appliance |
| 1 | "Humidity" 80%-90% | Open Dry Mode | Air Condition |
| 2 | "Current Time" 18: 00 | Turn on | Television |
| 3 | "Current Time" 19: 00 | To channel 5 | Television |
| 4 | … | … | … |
| | | | |
| | Predetermined State Parameter Value | Predetermined Controlling Command | |
| | | Operation Command | Home Appliance |
| 1 | "Temperature" 30~35° C | 25℃ Cooling Air | Air Condition |
| 2 | "Current Time" 07: 30 | Unfolding | Automatic Curtain |
| 3 | … | … | … |

FIG. 15

SMART GATEWAY, SMART HOME SYSTEM AND SMART CONTROLLING METHOD THEREOF

BACKGROUND

1. Technical Field

The present disclosure relates to smart home technology, and particularly to a smart gateway, a smart home system, and a smart controlling method for controlling home appliances and devices of the smart home system.

2. Description of Related Art

Smart home technology is popular. With this technology, all home devices in a house are connected to a smart home network system, so as to be controlled in unison, allowing a user to easily control the home devices from anywhere in the house. Most home appliances or devices need to be coupled to a special controller, which is complicated. However, it is problematic for the smart home network system to automatically control the home devices according to the changing habits and preferences of the user.

Therefore, there is room for improvement within the art.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

FIG. 8 is a diagram showing a mapping table used in the home system of FIG. 7.

FIG. 10 is a diagram showing a mapping table used in the home system of FIG. 9.

FIG. 15 is a diagram showing a smart command table used in the home system of FIG. 13.

DETAILED DESCRIPTION

The disclosure, including the accompanying, is illustrated by way of example and not by way of limitation. It should be noted that references to "an" or "one" embodiment in this disclosure are not necessarily to the same embodiment, and such references mean "at least one."

Figure 1:
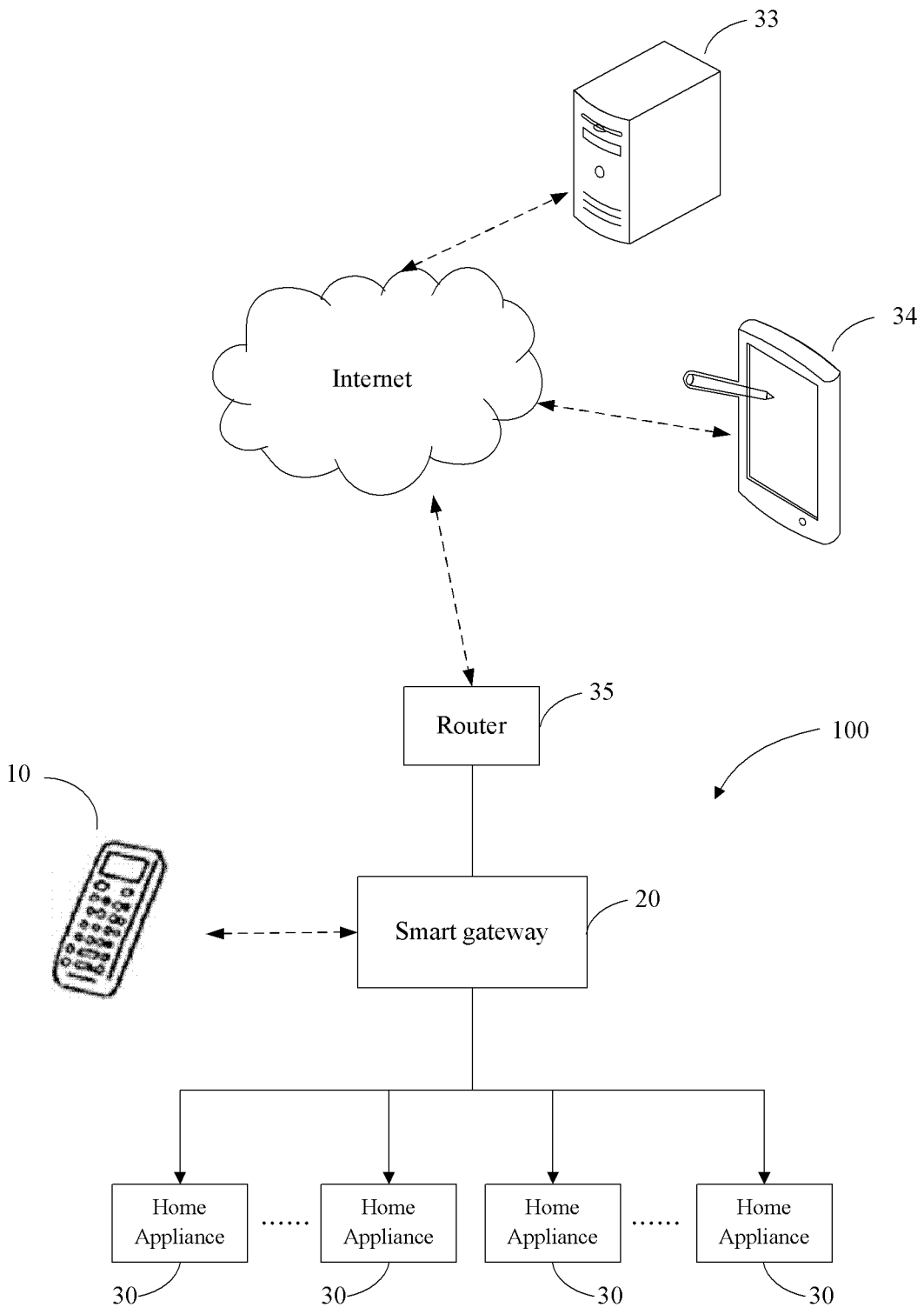
FIG. 1 is a schematic view showing a smart home system, according to an exemplary embodiment.

Referring to FIG. 1, a smart home system 100 is provided. The smart home system 100 includes a smart gateway 20 communicating with a server 33 and an Internet controller 34 via the Internet. The smart gateway 20 is connected to a wired or wireless router 35, thereby communicating with the Internet via the router 35. The Internet controller 34 can be a computer, a portable notebook, or the like connecting to the Internet via a wired or wireless Ethernet interface unit. The Internet controller 34 can also be a smart phone, a personal digital assistant (PDA), a tablet PC, or the like connecting to the Internet via the General Packet Radio Service (GPRS) network, the Code Division Multiple Access (CDMA) network, the $3^{ed}$ Generation (3G) Telecommunication network, the $4^{th}$ Generation (4G) Telecommunication network. or other networks of mobile Internet. The server 33 also connects to the Internet, thereby communicating with the smart gateway 20 and the Internet controller 34.

In this embodiment, the smart home system 100 further includes a remote controller 10. The remote controller 10 communicates with the smart gateway 20 via a wired or wireless communication mode. The remote controller 10 sends a control command to the smart gateway 20 according to a user's input, and the smart gateway 20 controls the home appliances 30 to execute an operation according to the control command. Furthermore, the smart gateway 20 receives the control command sent by the server 33 or the Internet controller 34, to control the home appliances 30 to execute the operations. The wireless communication mode includes, but is not limited to, IR, BLUETOOTH, Z-wave, NFC, ZigBee, WIFI, or other communication technologies; the wired communication mode can be Power Line Communication (hereinafter PLC), Optical Fiber Power Line Communication (hereinafter OPLC), wired Internet communication, coaxial cable communication, telephone line communication, or other communication technologies.

Figure 2:
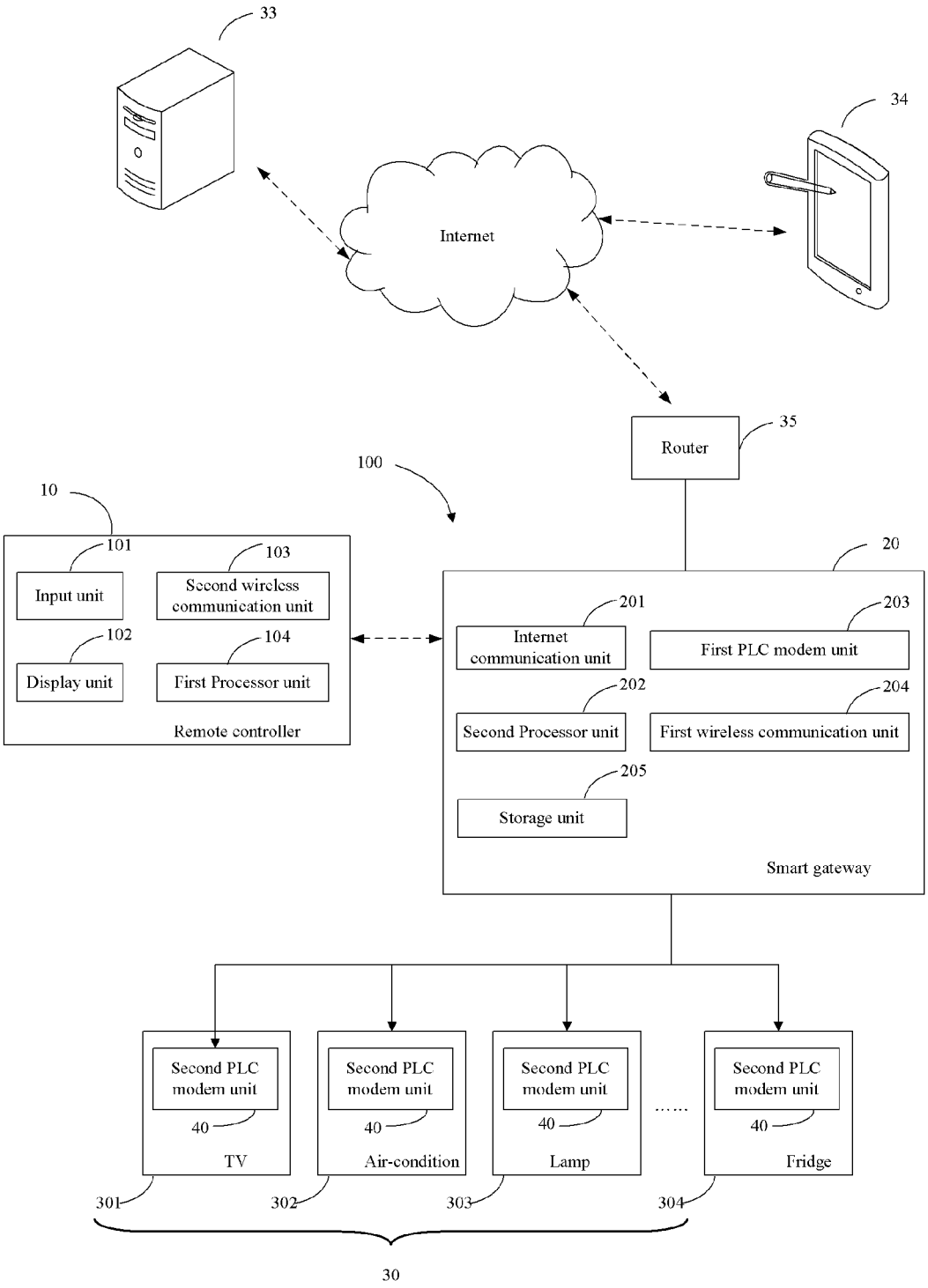
FIG. 2 is a block diagram of the smart home system of FIG. 1.

Referring to FIG. 2, a block diagram of the smart home system 100 is provided. The smart gateway 20 includes an Internet communication unit 201, a second processor unit 202, a first PLC modem unit 203, a first wireless communication unit 204, and a storage unit 205.

The smart gateway 20 communicates with each of the home appliances 30 in a wired or wireless communication mode, wherein the wireless communication mode includes, but is not limited to, IR, BLUETOOTH, Z-wave, NFC, Zigbee, WIFI, or other communication technologies; the wired communication mode can be PLC, OPLC, wired Internet communication, coaxial cable communication, telephone line communication, or other communication technologies. In this embodiment, the smart gateway 20 communicates with the home appliances 30 via the PLC technologies, the smart gateway 20 and parts of the home appliances 30 are connected to the power line. The power line not only supplies power to all electrical devices of consumers, but also serves as a carrier for data transmission between the smart gateway 20 and the home appliances 30. In other embodiments, the smart gateway 20 and the home appliances 30 are connected by an Optical Fiber Composite Low-voltage Cable, and communicate with each other via the OPLC technologies.

The storage unit 205 is configured for storing system information of the home system 100. The system information includes unique identification codes (UIDs) of the home appliances 30, location and setting parameters of the router 35, and verification information of registered users of the smart home system 100. The verification information includes a user name and secret code of the registered user.

Figure 3:
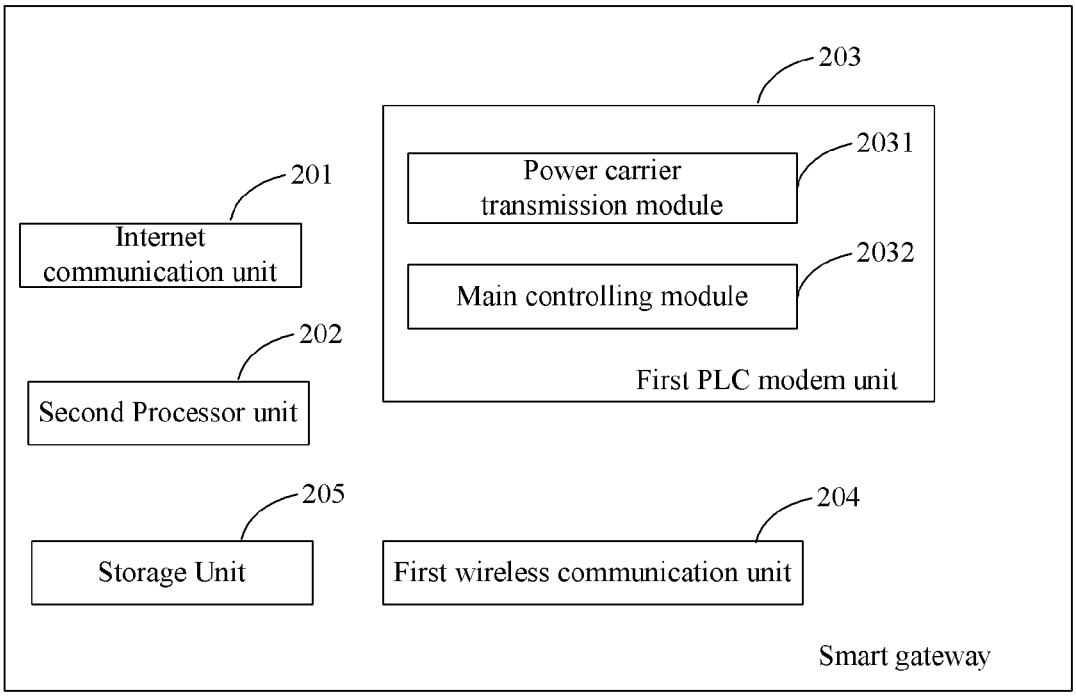
FIG. 3 is a block diagram of a smart gateway of the smart home system of FIG. 1.

Referring to FIG. 3, the first PLC modem unit 203 includes a power carrier transmission module 2031 and a main controlling module 2032. The main controlling module 2032 is configured for encoding and transmitting data. The power carrier transmission module 2031 is configured for modulating electronic signals into the power line and demodulating electronic signals from the power line.

Figure 4:
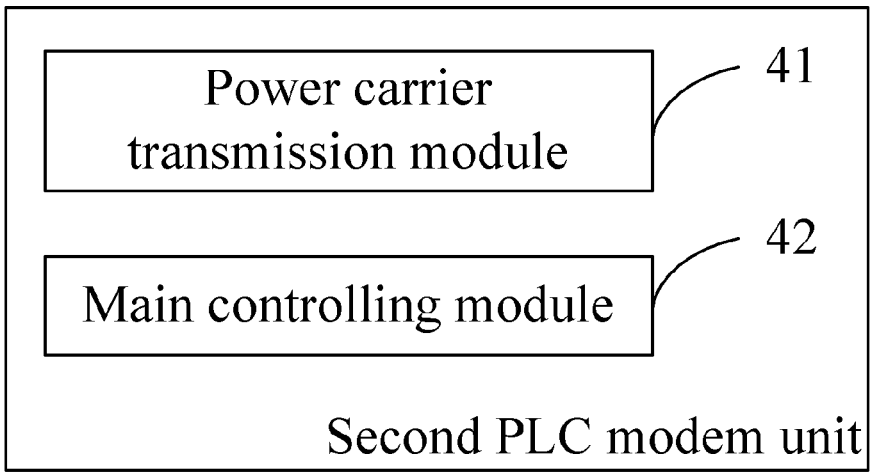
FIG. 4 is a block diagram showing a second Power Line Communication modem unit of home appliances of FIG. 1.

Referring to FIGS. 2 and 4, the home appliances 30 include, but are not limited to, a television 301, an air-conditioner 302, a lamp 303, a fridge 304, a door-keeper system (not shown), a socket(not shown), a fan (not shown), and an automatic curtain (not shown). Each of the home appliances 30 includes a second PLC modem unit 40, which is similar to the first PLC modem unit 203. The second PLC modem unit 40 includes a power carrier transmission module 41 configured for loading electronic signals to the power line and demodulating electronic signals from the power line, and a main controlling module 42 configured for data interacting, demodulating, encoding, and protocol converting.

The smart gateway 20 and the home appliances 30 each include a unique identification code (UID), all of the UIDs of the home appliances 30 are stored in the smart gateway 20, so that each of the home appliances 30 can be identified by the smart gateway 20. In detail, the first PLC modem unit 203 of the smart gateway 20 sends control signals that include the identification information of the target home appliance 30, and the second PLC modem unit 40 of the home appliances 30 determines whether or not the identification information of the received control signal matches their UID. Only the home appliance 30 with a matching UID creates a point-to-point communication between the smart gateway 20 and the matched home appliance 30.

Referring to FIG. 2 again, the remote controller 10 includes an input unit 101. a display unit 102, a second wireless communication unit 103, and a first processor unit 104. The first processor unit 104 generates a controlling command according to a user's input and sends the controlling command to the smart gateway 20 via the second wireless communication unit 103. The controlling command includes an operation command and the identification information of a target home appliance 30, which is assigned to execute the operation command.

The remote controller 10 can communicate with the smart gateway 20 in a wired or wireless communication mode, wherein the wireless communication mode includes, but is not limited to, IR, BLUETOOTH, Z-wave, NFC, ZIGBEE, WIFI, or other communication technologies; the wired communication mode can be Power Line Communication (hereinafter PLC), Optical Fiber Power Line Communication (hereinafter OPLC), wired Internet communication, coaxial cable communication, telephone line communication, or other communication technologies. In this embodiment, the remote controller 10 communicates with the smart gateway 20 via WIFI communication, the second wireless communication unit 103 of the remote controller 10 and the first wireless communication unit 204 of the smart gateway 20 each includes a WIFI communication module. In other embodiments, the remote controller 10 communicates with the smart gateway 20 via IR communication, and some of the home appliances 30, such as the television 301 or the air-conditioner 302, also receive IR control signals. The remote controller 10 directly sends IR control signals to this kind of home appliances 30 to control them.

Figure 5:
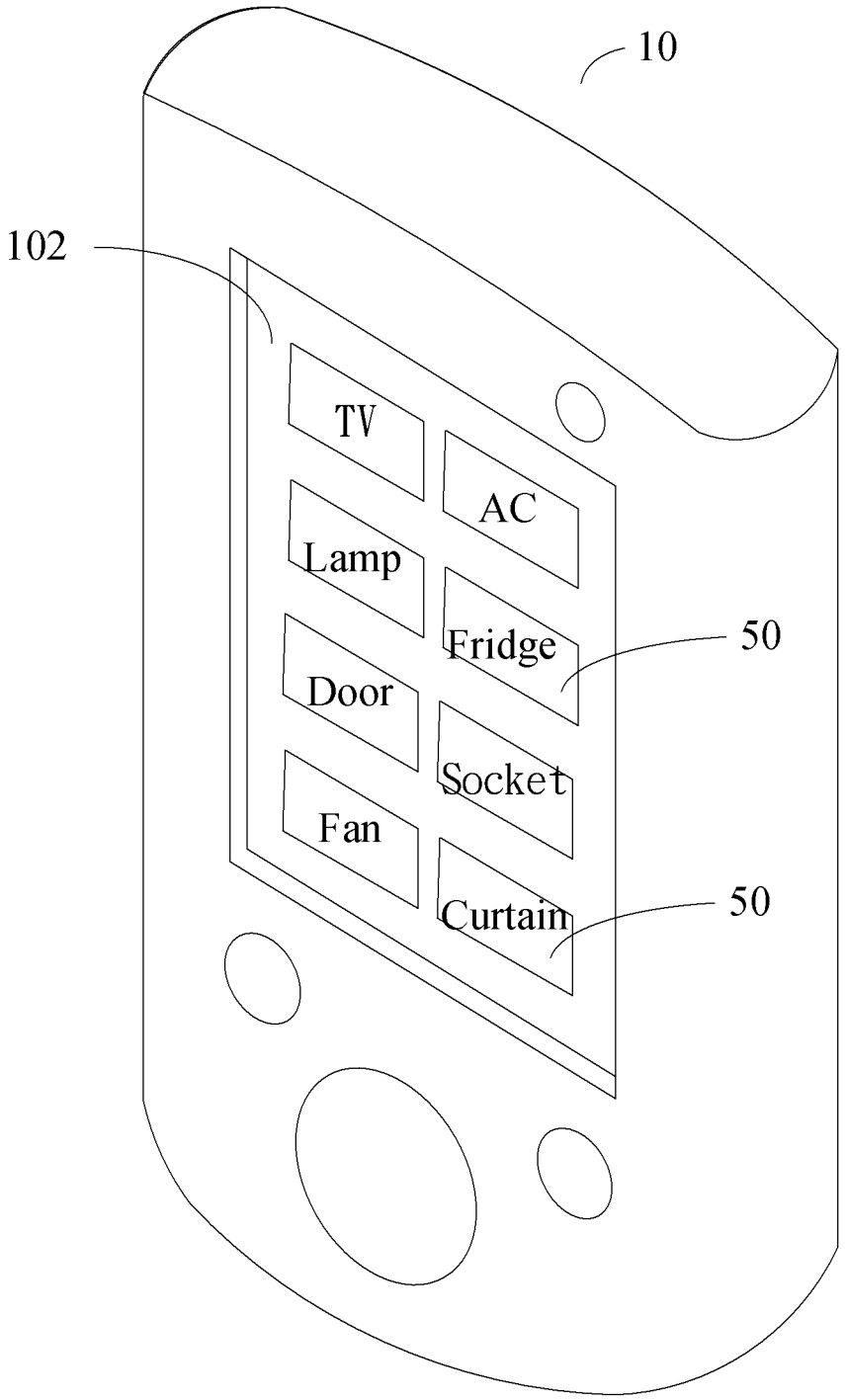
FIG. 5 is a block diagram of a remote controller of the smart home system of FIG. 1.

Referring to FIG. 5, an operation controlling interface of the remote controller 10 is provided. In this embodiment, the input unit 101 of the remote controller 10 is a touch screen. A controlling program is preloaded in the remote controller 10. The controlling program can be, but is not limited to, downloaded from an online applications store. The first processor unit 104 of the remote controller 10 runs the controlling program to display the operation controlling interface on the display unit 102. In detail, a number of icons 50 are displayed on the operation controlling interface. Each of the icons 50 corresponds to one of the home appliances 30. For example, the operation controlling interface displayed on the display unit 102 provides a layout of a house, and the icons 50 are arranged according to the arrangement of the home appliances 30 in the house. Users can select any of the home appliances 30 by choosing an icon 50 displayed on the display unit 102 by the input unit 101. The display unit 102 of the remote controller 10 further provides an operation menu of the selected home appliance 30 for entering selections. The first processor unit 104 responds to a user's selection, and sends the controlling command, which includes the selected operation command and the identification information of the selected home appliance 30, to the smart gateway 20 via the second wireless communication unit 103. In other embodiments, the input unit 101 is a plurality of buttons.

In this embodiment, the server 33 can be, but is not limited to, a cloud server with cloud storage and computing functions. The system information of the smart home system 100 is also stored in the server 33, as disclosed in FIG. 16. The system information includes the UIDs of the home appliances 30, a location and setting parameters of the smart gateway 20, and verification information of registered users of the smart home system 100. The verification information includes a user name and a secret code of the registered user.

Figure 6:
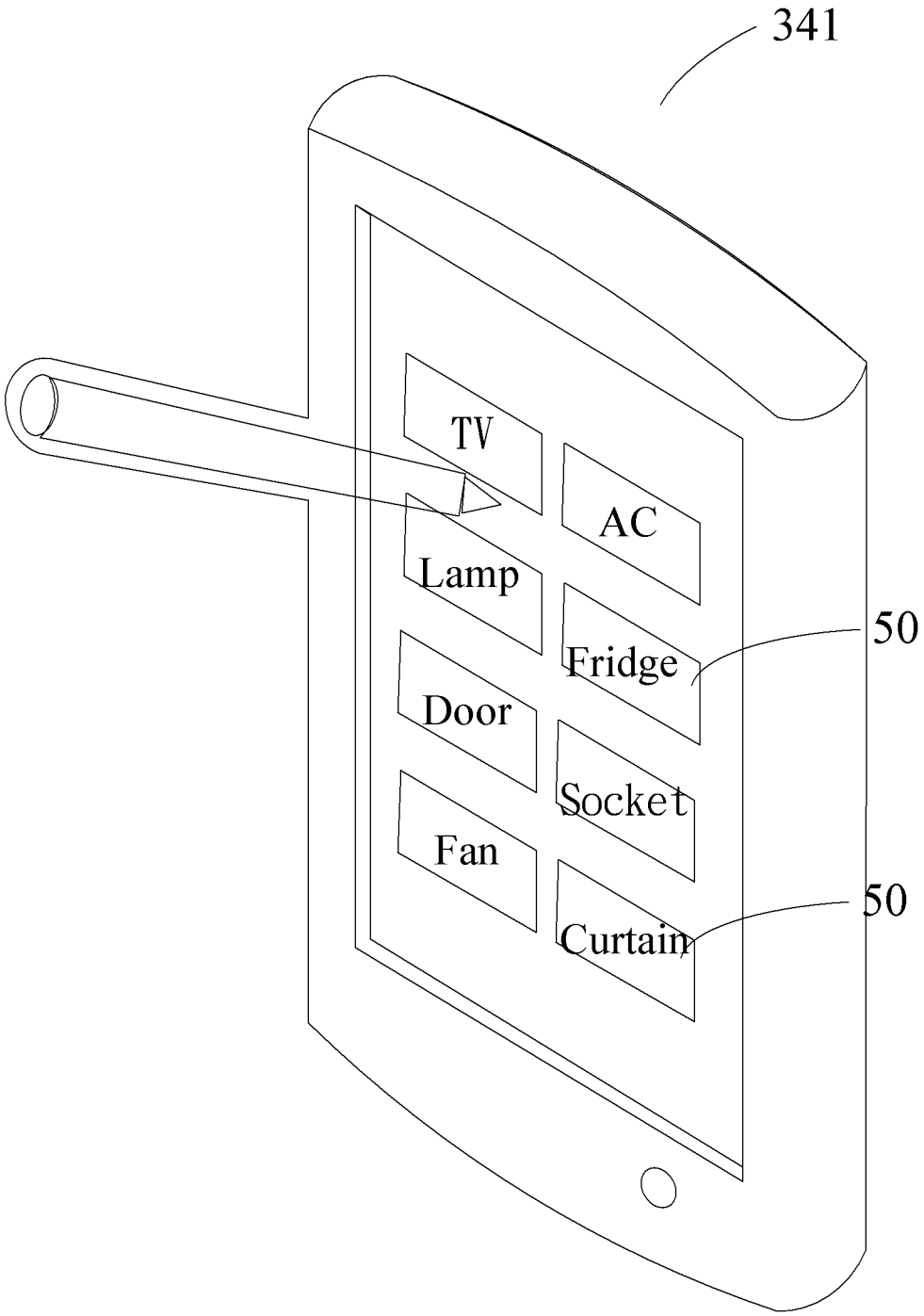
FIG. 6 is a schematic view showing an operation controlling interface displayed on the Internet controller of the smart home system of FIG. 1.

Referring to FIG. 6, in this embodiment, the Internet controller 34 is a smart portable device 341. The smart portable device 341 connects to the Internet via a WIFI (Wireless Fidelity) or WAPI (Wireless LAN Authentication and Privacy Infrastructure) network, General Packet Radio Service (GPRS) network, the Code Division Multiple Access (CDMA) network, the $3^{rd}$ Generation (3G) Telecommunication network or the $4^{th}$ Generation (4G) Telecommunication network, or the other networks of mobile Internet.

The smart portable device 341 also contains a smart home controlling program to run therein. When the smart home controlling program runs in the smart portable device 341, the smart portable device 341 sends an user name and a password input by the user to the server 33. The server 33 verifies whether or not the user name and the password is valid. If yes, the server 33 sends the system information of the home system 10 related to the user name to the smart portable device 341. The smart portable device 341 displays the operation controlling interface according to the system information. The operation interface provides a building layout of the house and a plurality of icons 50 corresponding to the home appliances 30. The icons 50 are arranged according to the arrangement of the home appliances 30 in the house. The smart portable device 341 also establishes communication with the smart gateway 20 according to the location and setting parameters of the router 35. The smart portable device 341 further provides the operations menu of the selected home appliance 30 for entering selections. The smart portable device 341 responds to a user's selection and sends the controlling command, which includes the selected operation command and the identification information of the selected home appliance 30, to the smart gateway 20.

In another embodiment, a peer to peer (P2P) technology is used. After the server 33 verifies the user name and the password sent by the smart portable device 341, the smart portable device 341 sends the controlling command, which includes the operation command and the identification information of the selected home appliance 30, to the router 35 directly. The router 35 transmits the controlling command to the smart gateway 20.

In another embodiment, the server 33 is a web server configured to provide the operation controlling interface. The smart portable device 341 accesses the server 33 to obtain the operation controlling interface. In detail, the server 33 verifies whether or not the user name and the password sent by the smart portable device 341 is valid, and permits the smart portable device 341 to download a web page of the operation controlling interface when the user name and the password is valid. The smart portable device 341 responds to a user's selection, and sends the controlling command including the operation command and the identification information of the selected home appliance 30 to the smart gateway 20. The operation controlling interface provides a building layout of the house and a number of icons 50 relating to the home appliances 30. The icons 50 are arranged according to the arrangement of the home appliances 30 in the house. The smart portable device 341 further provides the operations menu of the selected home appliance 30 for entering selections. The smart portable device 341 responds to a user's selection and sends the controlling command, which includes the operation command and the identification information of the selected home appliance 30 to the smut gateway 20.

In other embodiments, smart phone, personal digital assistant (PDA), or tablet PCs capable of connecting to the Internet via a wireless network, such as WIFI network, can serve as the Internet controller 34. The first wireless communication unit 204 of the smart gateway 20 can establish communication to the Internet controller 34, and receives the controlling command sent by the Internet controller 34 directly. This connecting manner is suitable for short range wireless communication, the smart gateway 20 can establish communication to the Internet controller 34 directly without bridging by the server 33.

The smart gateway 20 is connected to the Internet by the Internet communication unit 201. The server 33 and the Internet controller 34 are also connected to the Internet. The Internet communication unit 201 of the smart gateway 20 transmits the controlling commands sent by the server 33 or the Internet controller 34 to the second processor unit 202. The Internet communication unit 201 can be a wired Ethernet interface unit configured for connecting the smart gateway 20 to the router 35, thereby connecting the smart gateway 20 to the Internet. In other embodiments, the Internet communication unit 201 can be a WIFI or WAPI communication unit configured for connecting the smart gateway 20 to the router 35 wirelessly.

The second processor unit 202 receives the controlling commands sent by the server 33 or the Internet controller 34. The controlling command includes an operation command and the identification information of the home appliance 30, which executes the operation command. In this embodiment, the identification information is the UID of the home appliance 30. The second processor unit 202 further extracts the operation command and the UID of the home appliance 30, which executes the operation command from the controlling command.

The first PLC modem unit 203 sends a controlling signal, which includes the operation command and the UID of a home appliance 30, to the home appliance 30. The home appliance 30 that has the matching UID in the controlling signal executes the operation command. In detail, the main controlling module 2032 of the first PLC modem unit 203 encodes the controlling signal according to the operation command and the UID of the home appliance 30. The power carrier transmission module 2031 loads the controlling signal to the power line for sending the controlling signal to the target home appliance 30.

The home appliance 30 receives the controlling signal sent by the smart gateway 20 via the second PLC modem unit 40, and executes the operation according to the operation command included in the controlling signal. In detail, the power carrier transmission module 41 of the second PLC modem unit 40 demodulates controlling signals from the power line and determines whether or not the UID of the controlling signal matches the UID of itself. If the UIDs match, the power carrier transmission module 41 receives and parses the controlling signal; the main controlling module 42 extracts the operation command included in the controlling signal, and the home appliance 30 executes the required operation according to the operation command.

The smart home system 100 is connected to the Internet. The smart gateway 20 is not only capable of receiving the controlling command sent by the remote controller 10, but also capable of receiving the controlling command sent by the server 33 or the Internet controller 34. Users can remotely control the home appliance 30 in the smart home system 100 with the Internet controller 34, such as a common smart electronic device.

The first PLC modem unit 203 and the second PLC modem unit 40 communicate with each other. The UID of the smart gateway 20 is stored in the home appliance 30. Therefore, the home appliance 30 sends signals to the smart gateway 20 via power lines, and the first PLC modem unit 203 of the smart gateway 20 receives the signals via the power lines.

In other embodiments, the home appliances 30 connect to the smart gateway 20 wirelessly. Each UID of the home appliances 30 is uniquely identified by the smart gateway 20. Each of the home appliances 30 and the smart gateway 20 include a wireless communication module, such as BLUETOOTH, Z-wave, NFC, ZIGBEE, WIFI or WAPI communication module.

Figure 7:
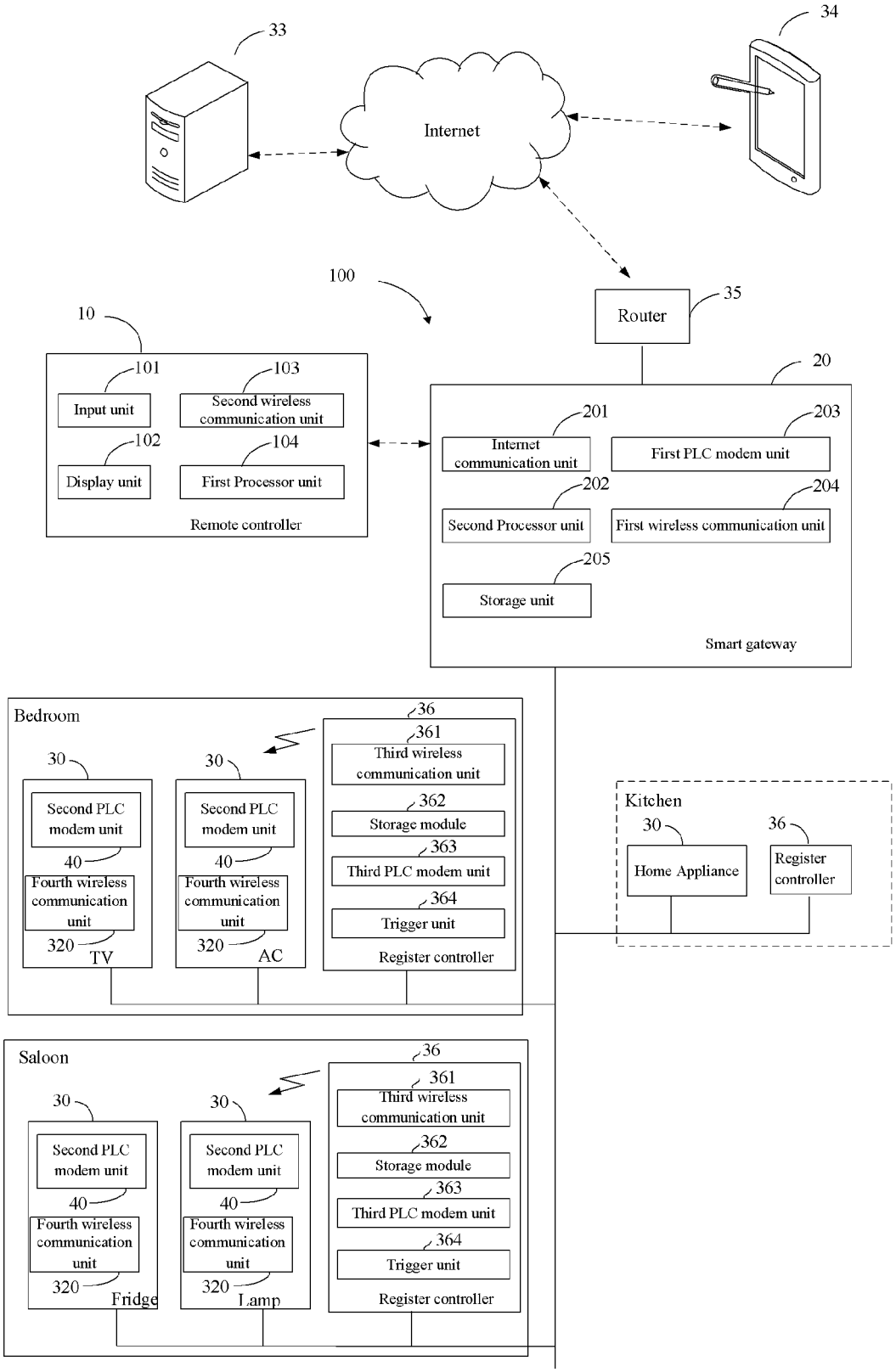
FIG. 7 is a block diagram of the smart home system coupled with a number of registration controllers.

Referring to FIG. 7, the smart home system 100 further includes at least one registration controller 36. In this embodiment, the smart home system 100 includes a number of registration controllers 36 arranged in rooms of the smart home system 100. The registration controller 36 includes a third wireless communication unit 361, a storage module 362, a third PLC modem unit 363, and a trigger unit 364. In this embodiment, the registration controllers 36 are connected to the power line, and communicate with the home appliances 30 via the PLC modem units. Each of the registration controllers 36 includes an UID stored in the storage module 362.

In this embodiment, the third wireless communication unit 361 includes an IR communication unit. The first wireless communication unit 204 of the smart gateway 20 also includes an IR communication unit. The registration controllers 36 communicate with the smart gateway 20 via IR communication. Each of the home appliances 30 includes a fourth wireless communication unit 320. The fourth wireless communication unit 320 also includes an IR communication unit for establishing communication with the registration controllers 36. The third wireless communication unit 361 sends out IR signals. In other embodiments, the third wireless communication unit 361 and the fourth wireless communication unit 320 can use BLUETOOTH, Z-wave, NFC, ZIGBEE, WIFI, or other communication technologies.

Each of the home appliances 30 needs to be registered in the smart gateway 20, so as to allow the smart gateway 20 to recognize the home appliance 30. A user uses the registration controller 36 to control the home appliances 30 in a room to automatically register with the smart gateway 20.

The registration controller 36 needs to be registered in the smart home system 100 in an initial state. To register the registration controller 36, the registration controller 36 is connected to the power supply and is located within the communicating range of the first wireless communication unit 204 of the smart gateway 20, and a registering program is run on the smart gateway 20. Then, the first wireless communication unit 204 of the smart gateway 20 establishes communication with the third wireless communication unit 361 of the registration controller 36, and the smart gateway 20 sends its UID to the registration controller 36. The registration controller 36 receives the UID of the smart gateway 20 and saves it in the storage module 362, thereby completing the registration process.

After registering the registration controller 36 in the smart home system 100, the home appliances 30 can be registered in the smart gateway 20. When the registration controller 36 is connected to the power line, the registration controller 36 sends a registering code to the home appliances 30 located within the communication range of the registration controller 36 via the third wireless communication unit 361, and sends a register request to the smart gateway 20 via the third PLC modem unit 363, in response to a user's input on the trigger unit 364. The registering code includes the UID of the smart gateway 20 and the UID of the registration controller 36, and the register request includes the UID of the registration controller 36. In this embodiment, the communication range of the registration controller 36 is within the room where the registration controller 36 is placed.

Referring to FIG. 8, each of the home appliances 30 located within the communication range of the registration controller 36 receives the registering code sent by the registration controller 36 via the fourth wireless communication unit 320, and establishes communication with the smart gateway 20 according to the UID of the smart gateway 20 included in the registering code. Each home appliance 30 sends a registration signal to the smart gateway 20. The registration signal includes the UID of the registration controller 36 and the UID of the home appliance 30.

The smart gateway 20 generates a region code corresponding to the UID of the registration controller 36 in response to the received register request sent by the registration controller 36. In this embodiment, the region code is the UID of the registration controller 36.

The smart gateway 20 assigns a corresponding region code to the home appliances 30 according to the UID of the registration controller 36 in the registration signal, and the UIDs of the home appliances 30 and the corresponding region code are recorded in a mapping table. In this embodiment, the smart gateway 20 stores the mapping table in the system information of the home system 100.

In this embodiment, the home system 100 includes a number of registration controllers 36 distributed in each room of the home system 100. Each of the registration controllers 36 includes a unique UID. The home appliances 30 located in one room respond to the trigger of the registration controller 36 in the same room to register with the smart gateway 20. The smart gateway 20 assigns a region code to every registering home appliance 30 and stores the UID of the home appliance 30 and the region code in the mapping table. Because the UIDs of the registering home appliances 30 and the UIDs of the registration controllers 36 are all unique, until the registered home appliance 30 is moved to a new room and receives a new register code sent by another registration controller 36, the region code corresponding to the UID of the home appliance 30 stored in the mapping table will not be replaced by a new region code.

In other embodiments, in response to a user's operation on the trigger unit 364, the third wireless communication unit 361 sends a registering code to the home appliances 30 located within the communication range of the registration controller 36, and the third PLC modem unit 363 sends a register request to the smart gateway 20 via the PLC modem units. The smart gateway 20 calls all the electronic devices on the power line to directly send their UIDs in response to the register request. In detail, the smart gateway 20 signals all the electronic devices on the power line in response to the register request to determine whether or not the UID of the registration controller 36 included in the register code received by the home appliance 30 is the same as the UID of the registration controller 36 included in the register request received by the smart gateway 20. If so, the smart gateway 20 requests the home appliances 30 to send their UIDs to the smart gateway 20 via the PLC modem units.

In other embodiments, a safety certification process is carried out in the registering process, either when registering the home appliance 30 on the smart gateway 20, or registering the registration controller 36 on the smart home system 100. When the registration controller 36 is registered on the smart home system 100, the first wireless communication unit 204 of the smart gateway 20 and the third wireless communication unit 361 of the registration controller 36 establish communication with each other. The smart gateway 20 sends its UID and a code to the registration controller 36. The code can be the UID of the smart gateway 20 or a random code. The registration controller 36 encrypts the registration request with the code before sending the registration request to the smart gateway 20. The registration controller 36 also packages the code in the registering code, and sends the registering code to the home appliances 30. The home appliance 30 also encrypts the registration signal with the received code. In this way, only the smart gateway 20 that generates the code can decode the registration request sent by the registration controller 36 and the registration signal sent by the home appliance 30. Therefore, other smart gateways connected to the power line, such as a smart gateway in a neighbor's house, cannot obtain the details of the registration request and the registration signal to control the home appliances 30.

Figure 9:
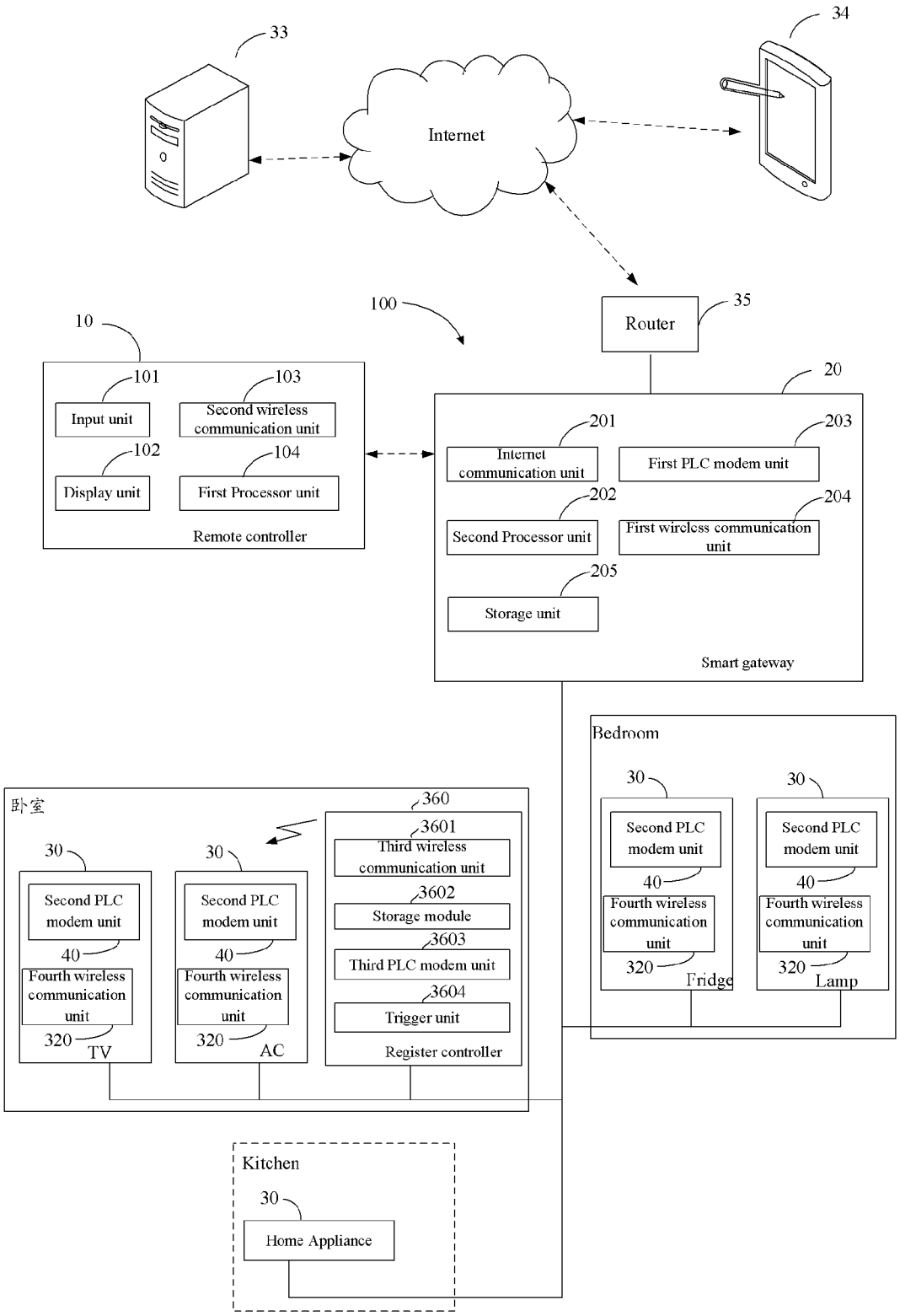
FIG. 9 is a block diagram of the smart home system coupled with only one registration controller.

Referring to FIG. 9, in another embodiment, the smart home system 100 includes only one registration controller 360. The registration controller 360 includes a third wireless communication unit 3601, a storage module 3602, a third PLC modem unit 3603 and a trigger unit 3604. The registration controller 360 is connected to the power line, and sends a registration request to the smart gateway 20 in PLC manner to register the home appliances 30 located within the communication range of the registration controller 360.

As previously mentioned, the registration controller 360 needs to be registered in the smart home system 100 in an initial state. To register the registration controller 360, the registration controller 360 is connected to the power line, and is located within the communicating range of the first wireless communication unit 204 of the smart gateway 20, and a registering program is run on the smart gateway 20. Then, the first wireless communication unit 204 of the smart gateway 20 and the third wireless communication unit 3601 of the registration controller 360 establish communication with each other, and the smart gateway 20 sends its UID to the registration controller 360. The registration controller 360 receives the UID of the smart gateway 20 and saves it into the storage module 3602, thereby completing the registration process.

After registering the registration controller 360 in the smart home system 100, the home appliances 30 can be registered in the smart gateway 20, the registration controller 360 must be located in the room containing the home appliances 30 needing to be registered or within the communication range of the home appliances 30. The registration controller 360 sends a register request to the smart gateway 20 via the third PLC modem unit 3603, in response to a user's input on the trigger unit 3604. The register request includes the UID of the registration controller 360. The smart gateway 20 generates a serial code, and a region code composing of the serial code and the UID of the registration controller 360, the smart gateway 20 further sends the serial code to the registration controller 360.

The registration controller 360 receives the serial code via the third PLC modern unit 3603, and sends a registration code to the home appliances 30 located within the communication range of the registration controller 360 via the third wireless communication unit 3601. The registration code includes the UID of the smart gateway 20, the UID of the registration controller 36, and the serial code.

Each of the home appliances 30 located within the communication range of the registration controller 360 receives the registration code sent by the registration controller 360 via the fourth wireless communication unit 320, and establishes communication with the smart gateway 20 according to the UID of the smart gateway 20 included in the registration code. Each home appliance 30 sends a registration signal to the smart gateway 20. The registration signal includes the serial code, the UID of the registration controller 360, and the UID of the home appliance 30.

Referring to FIG. 10, the smart gateway 20 assigns the corresponding region code to the home appliance 30 according to the serial code and the UID of the registration controller 360 contained in the registration signal, and records the UID of the home appliance 30 and the corresponding region code in a mapping table.

In this embodiment, the home system 100 includes only one registration controller 360, the registration controller 360 being taken to each room in turn of the smart home system 100, to register the home appliances 30 located in different rooms. The serial codes generated by the smart gateway 20 responding to a registration request are different each time. Therefore, the smart gateway 20 can generate different region codes to the home appliances 30 in different rooms of the smart home system 100, for example, when the registration controller 360 is located in a lounge of the smart home system 100, the smart gateway 20 receives a registration request and generates a first serial code, such as 01, the region code corresponding to the home appliances 30 in the lounge is composed of the first serial code "01" and the UID of the registration controller 360; then the registration controller 360 is taken to a bedroom of the smart home system 100, the smart gateway 20 receives a registration request again and generates a second serial code, such as 02, the region code corresponding to the home appliances 30 in the bedroom is composed of the second serial code "02" and the UID of the registration controller 360.

Figure 11:
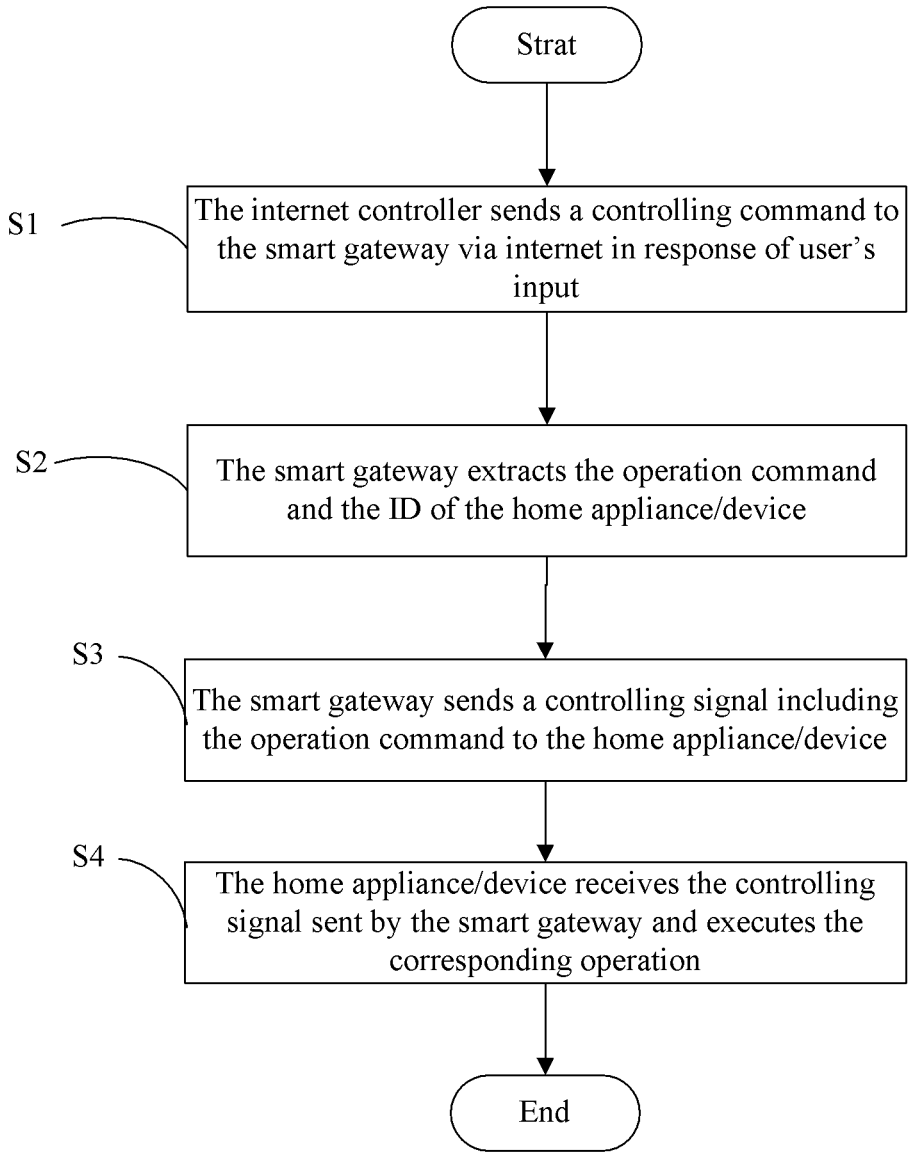
FIG. 11 is a flowchart illustrating a remote controlling method for controlling the home appliances of the smart home system of FIG. 2, according to an exemplary embodiment.

Referring to FIG. 11, a flowchart of a remote controlling method for controlling the home appliances 30 of the smart home system 100 is illustrated. The method includes the following steps, each of which is tied to various components contained in the smart home system 100 as shown in FIG. 2.

In step S1, the Internet controller 34 sends a controlling command to the smart gateway 20 via Internet in response to user's input, the controlling command includes an operation command and the UID of a home appliance 30 which is assigned to execute the operation command.

In step S2, the smart gateway 20 extracts the operation command and the UID of the home appliance 30 which is assigned to execute the operation command from the received controlling command. In detail, the Internet communication unit 201 of the smart gateway 20 receives the controlling commands sent by the server 33 or the Internet controller 34 and transmits the controlling commands to the second processor unit 202, the second processor unit 202 further extracts the operation command and the UID of the home appliance 30 which is assigned to execute the operation command from the controlling command. In this embodiment, the UID of the home appliance 30 is the UID of the second PLC modern unit 40.

In step S3, the smart gateway 20 sends a controlling signal including the operation command to the home appliance 30 which is assigned to execute the operation command. In detail, the main controlling module 2032 of the first PLC modem unit 203 encodes the controlling signal according to the operation command and the UID of the home appliance 30 which is assigned to execute the operation command extracted by the second processor unit 202, and the power carrier transmission module 2031 loads the controlling signal to the power line for sending the controlling signal to the target home appliance 30.

In step S4, the home appliance 30 receives the controlling signal sent by the smart gateway 20 and executes the required operation according to the operation command included in the controlling signal. In detail, the power carrier transmission module 41 of the second PLC modem unit 40 demodulates the controlling signals from the power line and determines whether or not the UID of the controlling signal matches the UID of itself; if the UIDs match, the power carrier transmission module 41 receives the controlling signal; the main controlling module 42 extracts the operation command included in the controlling signal and the home appliance 30 executes the operation according to the operation command.

In other embodiments, the smart gateway 20 communicates with each of the home appliances 30 via a wireless communication mode, wherein the wireless communication mode includes, but is not limited to, IR, BLUETOOTH, Z-wave, NFC, Zigbee, WIFI, or other communication technologies. In that way, in step 4, the smart gateway 20 sends a controlling signal via the first wireless communication unit 204. In step S5, the home appliance 30 receives the controlling signal via the fourth wireless communication unit 320.

Figure 12:
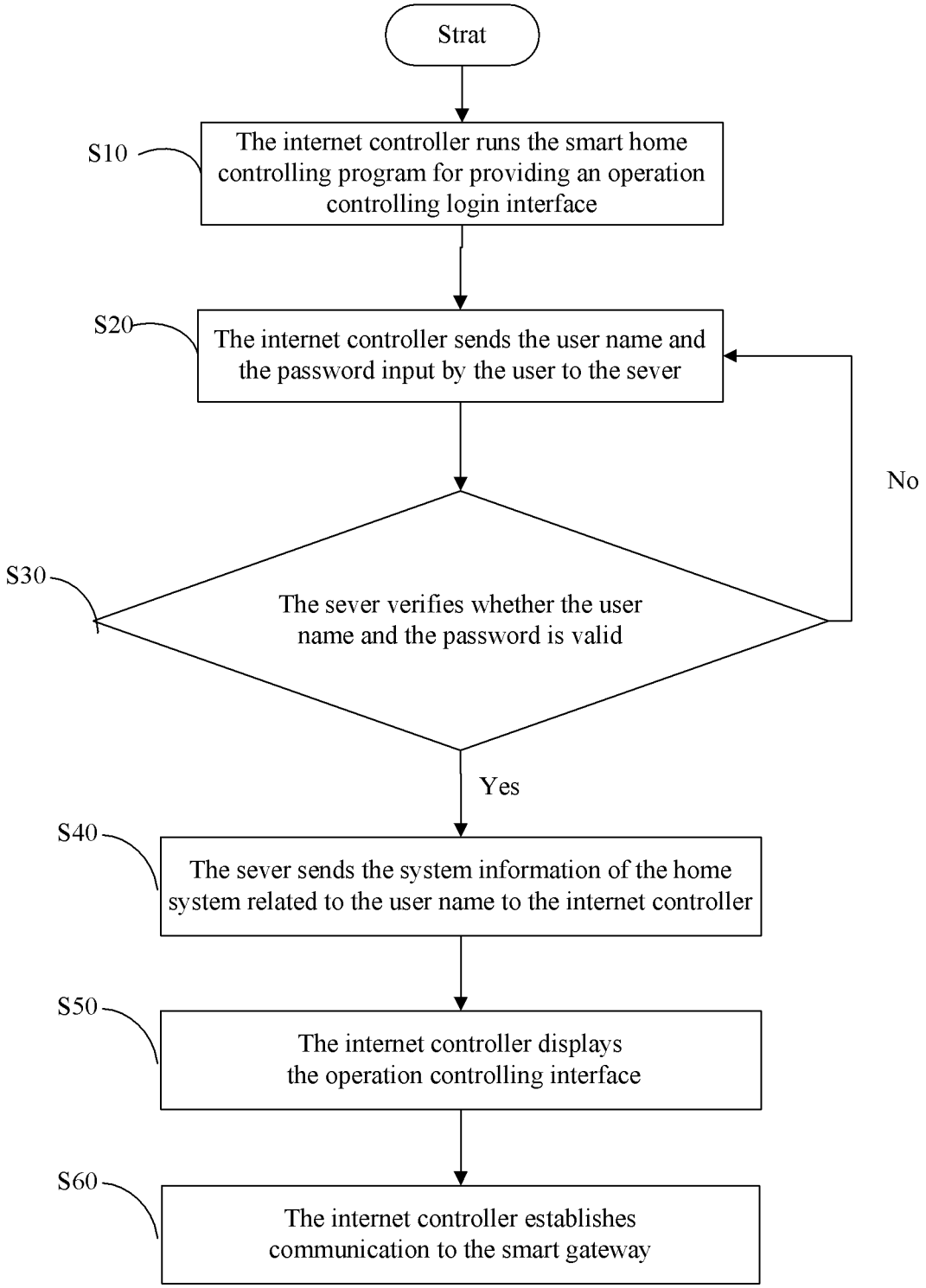
FIG. 12 is a sub-flowchart of the remote controlling method of FIG. 11.

Referring to FIG. 12, the remote controlling method of the home appliances 30 of the smart home system 100 shown in FIG. 1I further includes the following steps before the step S1:

In step S10, the Internet controller 34 runs the smart home controlling program for providing an operation control login interface.

In step S20, the Internet controller 34 sends the user name and the password input by the user to the server 33.

In step S30, the server 33 verifies whether the user name and the password are valid; if yes, process goes to step S40 if not, it reverts to step S20.

In step S40, the server 33 sends the system information of the home system 10 related to the user name to the Internet controller 34.

In step S50, the Internet controller 34 displays the operation controlling interface.

In step S60, the Internet controller 34 establishes communication with the smart gateway 20 according to the location and setting parameters of the router 35 included in the system information.

Figure 13:
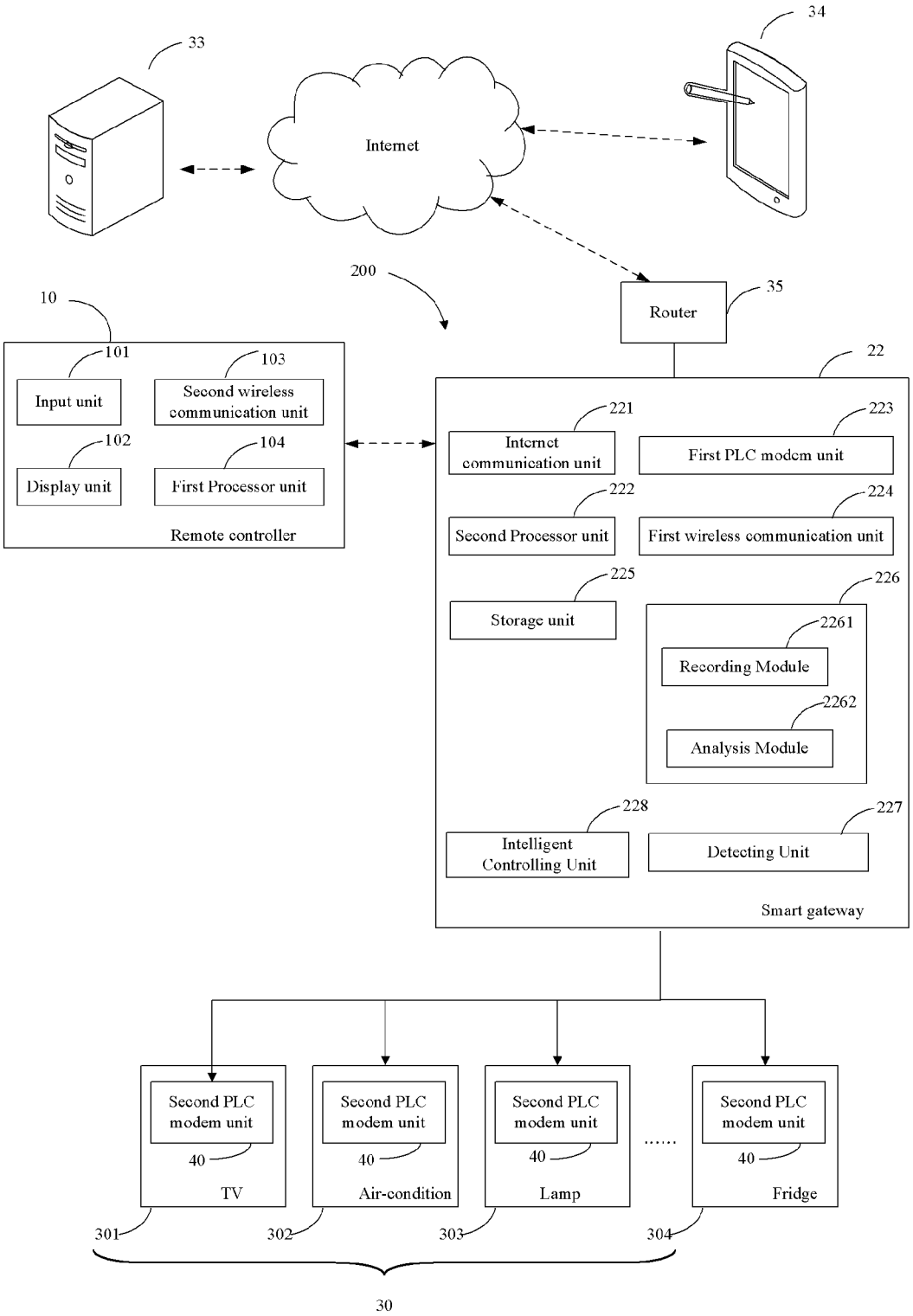
FIG. 13 is a block diagram of the smart home system, according to another embodiment.

Referring to FIG. 13, the smart home system 200 is similar to the smart home system 100 mentioned in FIG. 2. The smart home system 200 also includes a remote controller 10, a smart gateway 22 communicating with a server 33 and an Internet controller 34 via the Internet, and the smart gateway 22 also communicates with a number of home appliances 30. The home appliances 30 include, but are not limited to, a television 301, an air-conditioner 302, a lamp 303, a fridge 304, a door-keeper system (not shown), a socket (not shown), a fan (not shown), and an automatic curtain (not shown). The smart gateway 22 includes an Internet communication unit 221, a second processor unit 222, a first PLC modem unit 223, a first wireless communication unit 224, and a storage unit 225.

The difference between the smart home system 200 and the smart home system 100 is that, the smart home system 200 further includes a learning unit 226, a detecting unit 227, and an intelligent controlling unit 228. In this embodiment, the learning unit 226, the detecting unit 227, and the intelligent controlling unit 228 are arranged in the smart gateway 22.

Figure 14:
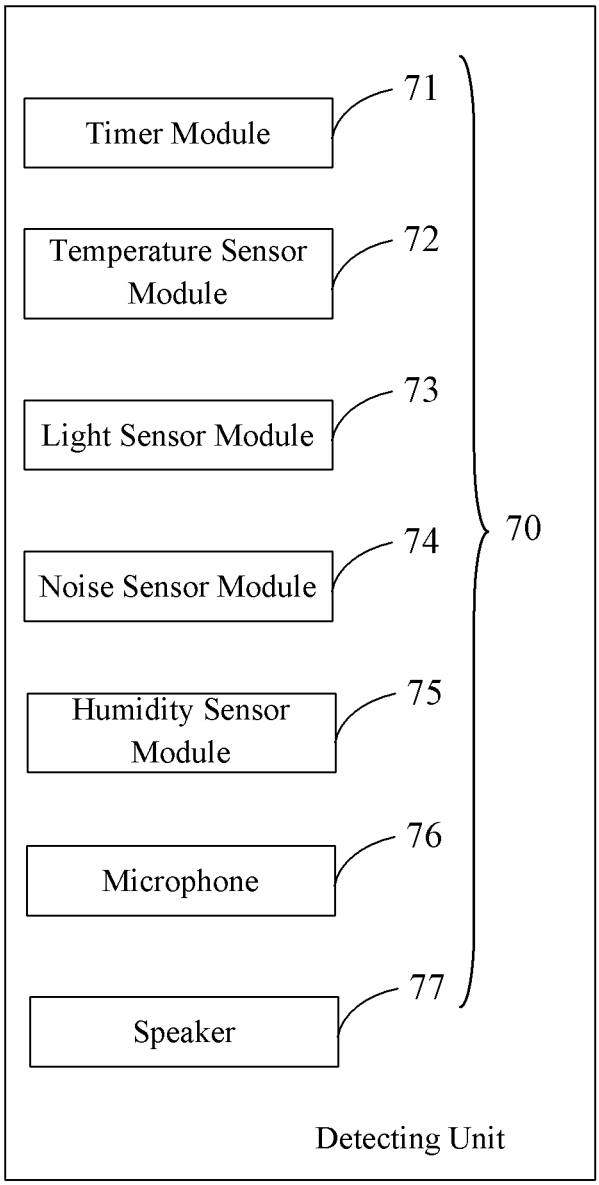
FIG. 14 is a block diagram of a detecting unit of the smart home system of FIG. 13.

Referring to FIG. 14, the detecting unit 227 includes a number of detecting modules 70, the detecting modules 70 include at least a timer module 71, a temperature sensor module 72, a light sensor module 73, a noise sensor module 74, and a humidity sensor module 75. The detecting unit 227 is configured to detect real time values of certain conditions of the smart home system 200, and each of the detecting modules 70 detects the real time value of a certain condition. For example, the timer module 71 obtains the current time of the smart home system 200, the temperature sensor module 72 detects and obtains the temperature of the room which the temperature sensor module 72 is located, the light sensor module 73 detects and obtains the ambient light intensity, the noise sensor module 74 obtains the level of noise and the humidity sensor module 75 obtains the value of the ambient humidity.

In this embodiment, the detecting unit 227 further includes a microphone 76 and a speaker 77. The microphone 76 converts captured sound to electronic signals and sends the electronic signals to the smart gateway 22, the smart gateway 22 parses the electronic signals via voice control technology. In this way, the smart gateway 22 can recognize the voice of the user as controlling commands and controls the target home appliance 30 to execute the operation command. The speaker 77 is configured to generate various kinds of sounds in response to the controlling of the smart gateway 22. In another embodiment, a cloud computing technology can be employed to recognize the controlling command.

Each of the certain conditions corresponds to a controlling command. For example, users habitually turn on or turn off a home appliance 30 at a special time, so a certain condition of "time" corresponds to an operation command of "Power On/Off" applied on some home appliances 30; the operation command of "Dim/Brighten" applied on a lamp 303 corresponds to the ambient light intensity, so the operation command of "Dim/Brighten" applied on a lamp 303 corresponds to the certain condition of "ambient light intensity"; the operation command of "Temperature Up/Down" applied on a air-conditioner 302 corresponds to the certain condition of "temperature". Each controlling command corresponds to a certain condition, and a certain condition may correspond to two or more controlling commands. A relationship table including the relationship between the certain condition and the controlling command is stored in the storage unit 225.

The learning unit 226 includes a recording module 2261 and an analysis module 2262. When the second processor unit 222 receives the controlling commands sent by the server 33 or the Internet controller 34, the recording module 2261 determines what is the type of the certain condition which corresponds to the controlling command and obtains the current value of the determined certain condition. The recording module 2261 further records the controlling command and the corresponding certain condition value in the storage unit 225 as an operational record. For example, the controlling command received by the second processor unit 222 is an operation command of "Power On" applied to the home appliance 30 of "TV", and the certain condition corresponding to this controlling command is timed, the recording module 2261 records the controlling command and the current time obtained by the timer module 71 as an operational record in the storage unit 225. If the controlling command received by the second processor unit 222 is an operation command of "open dry mode" applied to the home appliance 30 of "air-conditioner", the certain condition corresponding to this controlling command is humidity of environment, similarly the recording module 2261 records the controlling command and the humidity value detected by the humidity sensor module 75 as an operational record.

The smart home system 200 learns the habits of the user only when a command becomes a "habit"; a "habit" in the exemplary embodiment means that a controlling command is applied or repeated under the same conditions (i.e., under the same certain condition value or values) for more than a predetermined number of times in a predetermined period. The analysis module 2262 is configured for analyzing the operational records and determining which of the controlling commands is a habit according to the number of times the controlling command is applied or repeated under a same certain condition value or values within a predetermined time period, and records the habit controlling command and the corresponding habit certain condition value or values in an intelligent command table. The intelligent command table is stored in the storage unit 225.

For example, in a predetermined period of 7 days, the predetermined number of times being five, if the user powers on the television 301 at 18 o'clock five times or more, then the recording module 2261 has a record of five operations of "power on at 18 o'clock" and "power on at 18 o'clock" is taken as a habit. The analysis module 2262 records the habit controlling command "powers on the television 301" and the habit certain condition value "at 18 o'clock", in an intelligent command table.

In an alternative embodiment, the analysis module 2262 further analyses the operational records and determines which controlling commands are habitual according to the times of the repeated operations in a same certain condition value range or ranges within a predetermined time period, and records the habit controlling command and the corresponding habit certain condition value range or ranges in an intelligent command table.

For example, in a predetermined period of 7 days, the predetermined number of times is three, the certain condition is humidity and the value ranges of the humidity are divided into ten states, including 0%-10%, 11%-20% . . . and 90-%-100%. The learning controlling command is an operation command of "open dry mode" applied on the home appliance 30 of "air-conditioner." If the user sends an operation command of "open dry mode" applied to the home appliance 30 of "air-conditioner" three times or more in a humidity state of 80%-90%, the analysis module 2262 records the habit controlling command and the habit certain condition value range in the intelligent command table, and this controlling command is taken as a habit.

Referring to FIG. 15, a number of habit controlling commands and the corresponding habit certain condition values are recorded in the intelligent command table. In this embodiment, if a record of the habit controlling command and the corresponding habit certain condition value already exists in the intelligent command table, a new record determined by the analysis module 2262 will replace the original one, updating the intelligent command table.

In an alternative embodiment, the intelligent command table further includes one or more predetermined certain condition values and predetermined controlling command. The predetermined certain condition value and the corresponding predetermined control are set by user. For example, the predetermined certain condition value "temperature" of 30~35° C., and the corresponding predetermined controlling command "cool to 25° C." to the "air-conditioner".

Both of the habit certain condition and the predetermined certain condition are intelligent certain conditions, the corresponding habit controlling command and predetermined controlling command are intelligent controlling commands. When the detecting unit 227 detects that the current certain condition value is matched to one of the habit certain conditions or the predetermined certain conditions, the smart home system 200 calls the relevant habit controlling command or the predetermined controlling command to control the relative home appliance 30 to execute the required operation.

The detecting modules 70 of the detecting unit 227 detect the current certain condition values, and send the current certain condition values to the intelligent controlling unit 228.

The intelligent controlling unit 228 receives the current certain condition values, and sends the predetermined control command to the second processor unit 222 corresponding to the predetermined certain condition which matches the current certain condition value. When there is no predetermined certain condition matching the current certain condition value, the intelligent controlling unit 228 further sends the habit controlling command to the second processor unit 222 corresponding to the habit certain conditions which matches the current certain condition value. In detail, the intelligent controlling unit 228 determines whether the current certain condition value matches one of the predetermined certain conditions; if yes, sends the predetermined controlling command to the second processor unit 222 corresponding to the predetermined certain condition which matches the current certain condition value. When there is no predetermined certain condition matching the current certain condition value, the intelligent controlling unit 228 determines whether the current certain condition value matches one of the habit certain conditions; if yes, sends the habit controlling command to the second processor unit 222 corresponding to the habit certain condition which matches the current certain condition value.

The second processor unit 222 receives the predetermined controlling command or the habit controlling command, and extracts the operation command and the UID of the home appliance 30, which executes the operation command from the predetermined controlling command or the habit controlling command. The controlling process of the smart home system 200 is similar to the smart home system 100 mentioned before.

With such configuration, the smart home system 200 tracks the users' habits of using control commands and adjusts itself to match the users' habits.

Figure 16:
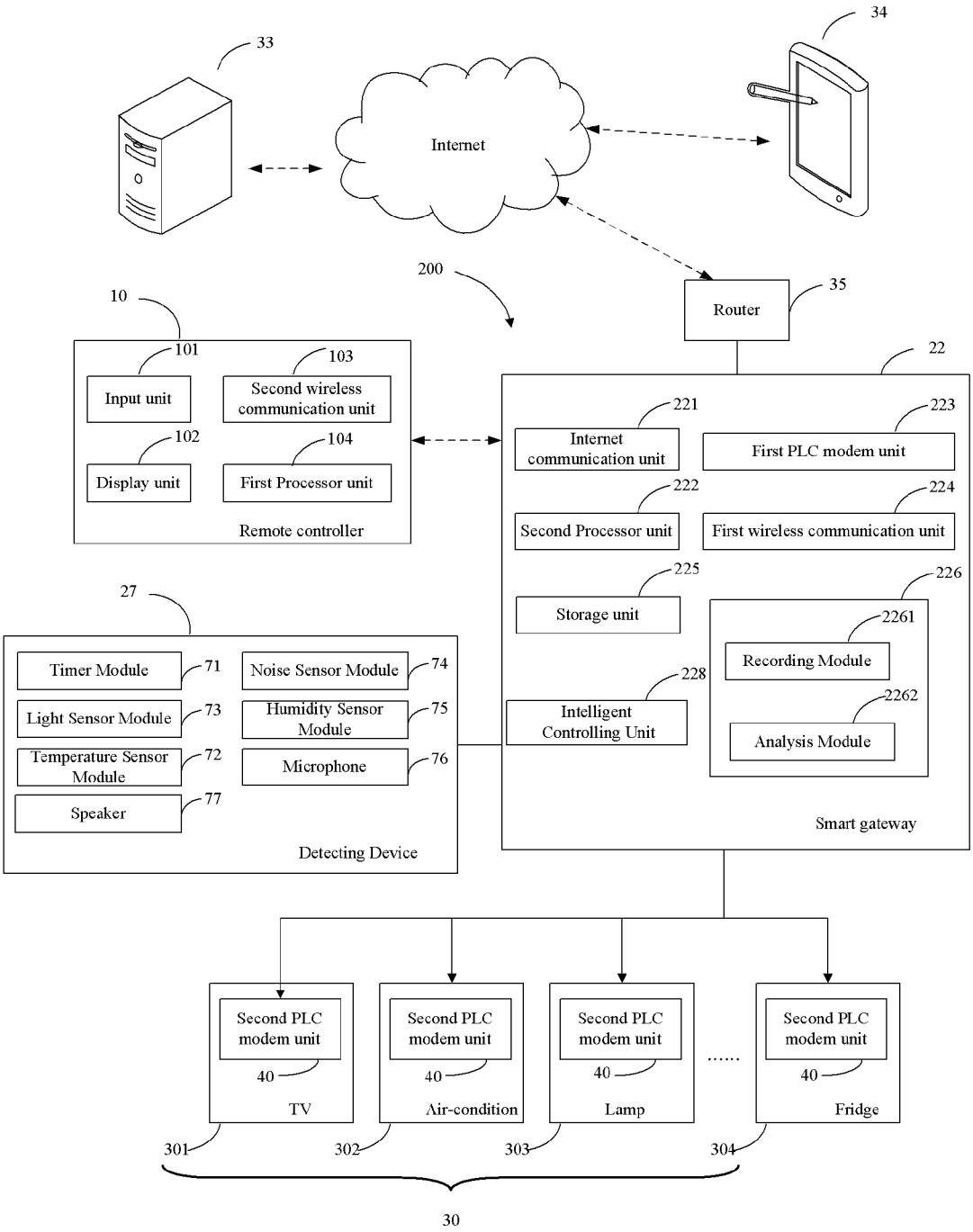
FIG. 16 is a block diagram of the smart home system, according to another embodiment.

Referring to FIG. 16, in another embodiment, the detecting unit 227 is not arranged in the smart gateway 22, a detecting device 27 is employed and located in rooms of the smart home system 200. The detecting device 27 communicates with the first wireless communication unit of the smart gateway 22 wirelessly. In an alternative embodiment, the detecting device 27 communicates with smart gateway 22 via a wired or wireless communication mode, wherein the wireless communication mode may include, but is not limited to, IR, BLUETOOTH, Z-wave, NFC, Zigbee, WIFI, or other communication technologies; the wired communication mode can be PLC, OPLC, wired Internet communication, coaxial cable communication, telephone line communication, or other communication technologies.

The detecting device 27 is similar to the detecting unit 227, including a timer module 71, a temperature sensor module 72, a light sensor module 73, a noise sensor module 74, a humidity sensor module 75, a microphone 76, and a speaker 77.

In an alternative embodiment, the detecting modules of the detecting unit 227 or the detecting device 27 can be divided into a number of sensors to sense the various certain conditions.

In another embodiment, the server 33 is a platform having computing and storing function. The learning unit 226 and the intelligent controlling unit 228 are arranged in the server 33, the intelligent command table is also stored in the server 33.

Figure 17:
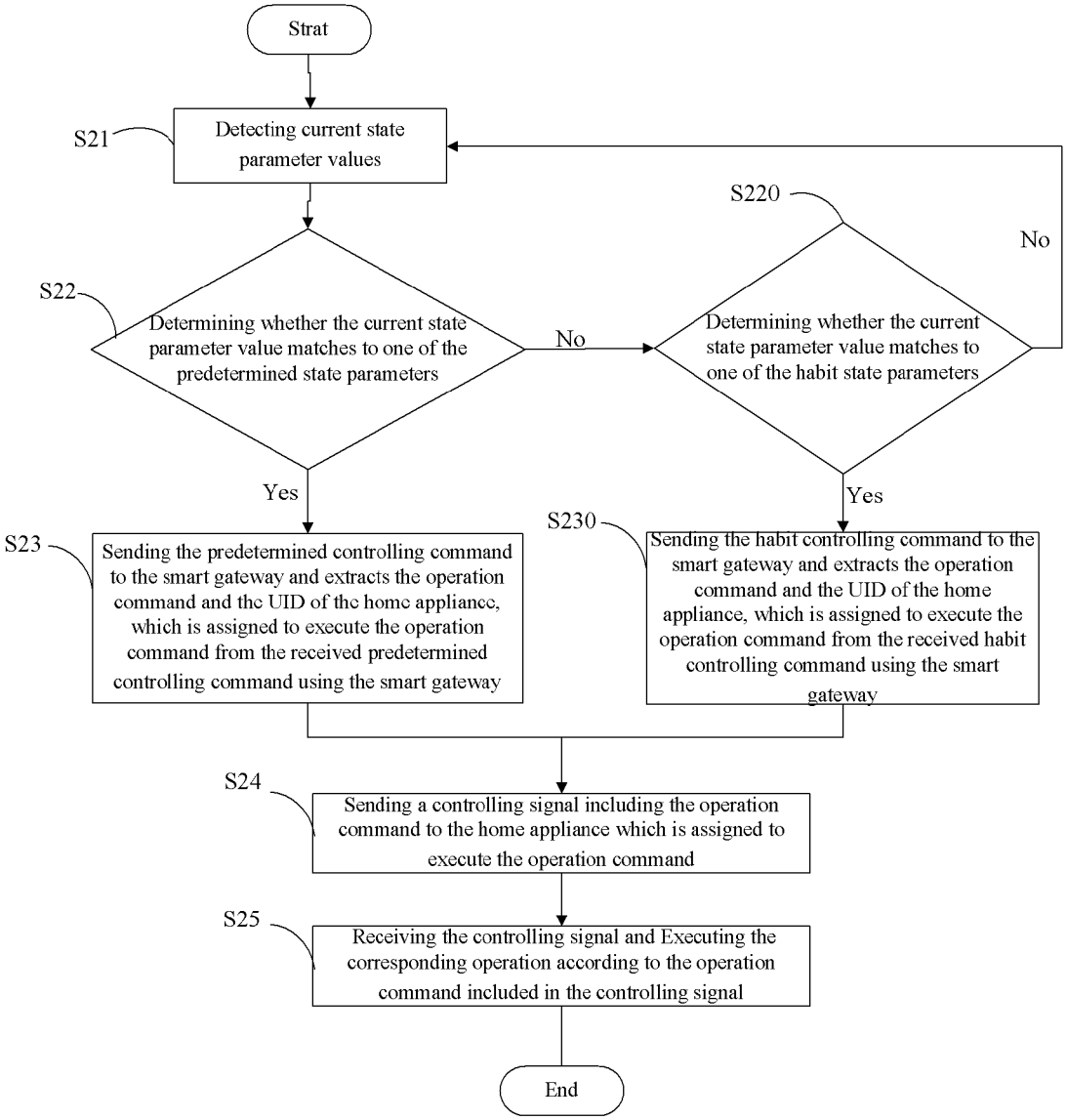
FIG. 17 is a flowchart illustrating a remote controlling method for controlling the home appliances of the smart home system of FIG. 13, according to an exemplary embodiment.

Referring to FIG. 17, a flowchart of a controlling method of the home appliances 30 of the smart home system 200 according to an embodiment is illustrated. The method includes the following steps, each of which is tied to various components contained in the smart home system 200 as shown in FIG. 13.

In step S21, the detecting unit 227 detects the current certain condition values. In detail, the detecting modules 70 of the detecting unit 227 detect the current certain condition values, and send the current certain condition values to the intelligent controlling unit 228.

In step S22, the intelligent controlling unit 228 determines whether the current certain condition value matches one of the predetermined certain conditions; if yes, process goes to step S23, if not, process goes to step S220.

In step S23, the intelligent controlling unit 228 sends the predetermined controlling command to the second processor unit 222 of the smart gateway 22 corresponding to the predetermined certain condition which matches the current certain condition value, and the second processor unit 222 of the smart gateway 22 extracts the operation command and the UIDs of the home appliance 30, which is assigned to execute the operation command from the received predetermined controlling command.

In step S220, the intelligent controlling unit 228 determines whether the current certain condition value matches one of the habit certain conditions; if yes, process goes to step S230, if not, process goes back to step S21.

In step S230, the intelligent controlling unit 228 sends the habit controlling command to the second processor unit 222 of the smart gateway 22 corresponding to the habit certain conditions which match the current certain condition value, and the second processor unit 222 of the smart gateway 22 extracts the operation command and the UID of the home appliance 30, which is assigned to execute the operation command from the received habit controlling command.

In step S24, the smart gateway 22 sends a controlling signal including the operation command to the home appliance 30 which is assigned to execute the operation command.

In step S25, the home appliance 30 receives the controlling signal sent by the smart gateway 22 and executes the required operation according to the operation command included in the controlling signal.

Figure 18:
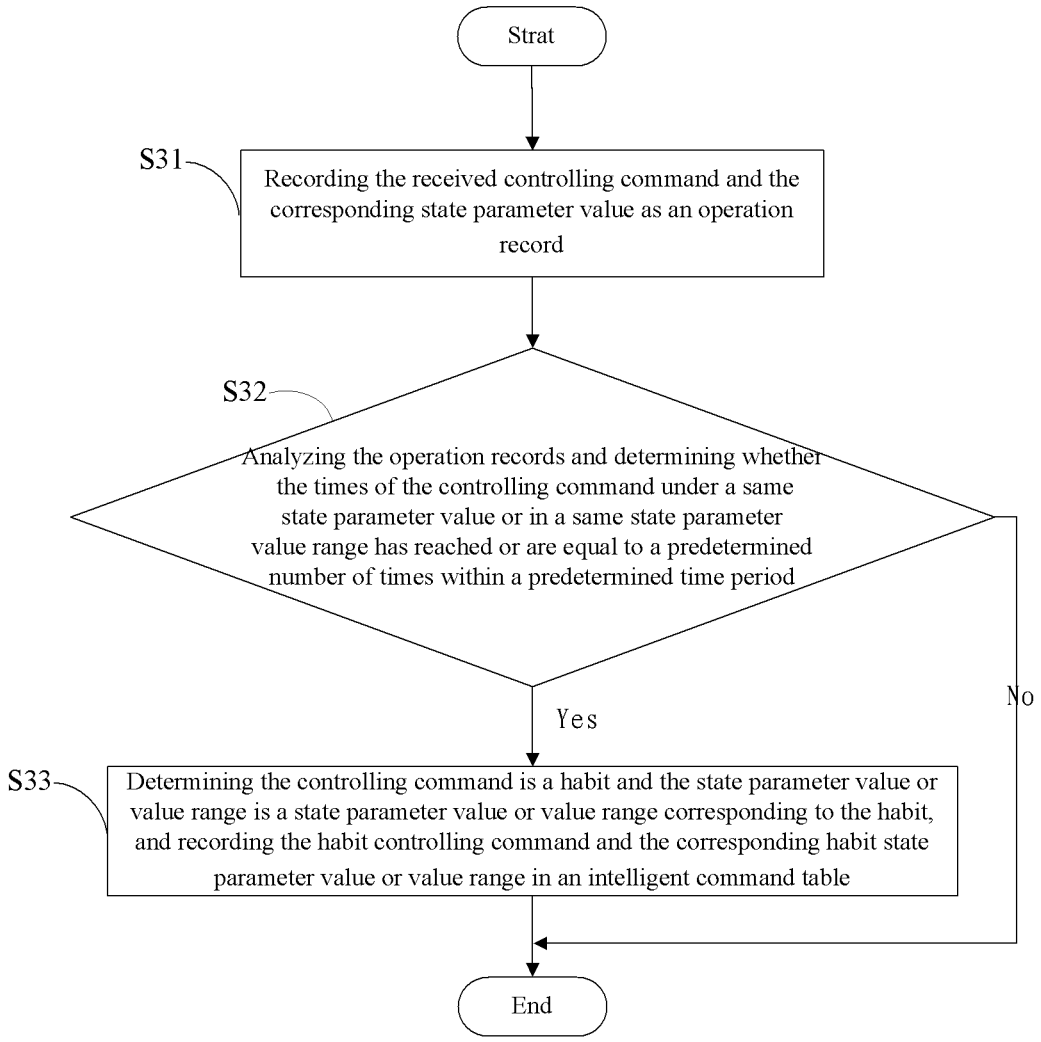
FIG. 18 is a flowchart illustrating an intelligent controlling method of the smart home system of FIG. 13, according to an exemplary embodiment.

Referring to FIG. 18, a flowchart of an intelligent controlling method of the smart home system 200 according to an exemplary embodiment is illustrated. The method includes the following steps, each of which is tied to various components contained in the smart home system 200 as shown in FIG. 13.

In step S31, the recording module 2261 of the smart gateway 22 records the received controlling command and the corresponding certain condition value as an operation record and stores the operation record in the storage unit 225. In detail, when the second processor unit 222 receives the controlling commands sent by the server 33 or the Internet controller 34, the recording module 2261 determines what type of certain condition corresponds to the controlling command and obtains the current value of the determined certain condition, the recording module 2261 further records the controlling command and the corresponding certain condition value in the storage unit 225 as an operational record.

In step S32, the analysis module 2262 of the smart gateway 22 analyses the operational records and determines whether or not the number of times that the controlling command under a same certain condition value or in a same certain condition value range has been given has reached or is equal to a predetermined number of times within a predetermined time period; if yes, the process goes to step S33, otherwise it goes to end.

In step S33, the analysis module 2262 of the smart gateway 22 determines whether the controlling command is a habit and the certain condition value or value range is a certain condition value or value range corresponding to a habit, and records the habit controlling command and the corresponding habit certain condition value or value range in an intelligent command table.

This disclosure may be embodied in other forms without departing from the spirit thereof. Thus, the present examples and embodiments are to be considered in all respects as illustrative and not restrictive, and the disclosure is not to be limited to the details given herein.

What is claimed is:

1. A smart controlling method applied to a smart home system, for controlling a plurality of home appliances of the smart home system, the smart home system comprising a detecting unit, a smart gateway communicating to the home appliances, and an intelligent command table comprising a plurality of predetermined certain condition values and predetermined controlling commands corresponding to the plurality of predetermined certain condition values, a plurality of habit certain condition values and habit controlling commands corresponding to the plurality of habit certain condition values, each of the plurality of predetermined controlling commands and the plurality of habit controlling commands comprising an operation command and a unique identification code of a home appliance which is assigned to execute the operation command; the smart gateway controlling the home appliances to execute a corresponding operation according to a received control command; the smart controlling method comprising:

a, detecting current certain condition value using the detecting unit;

b, determining whether the current certain condition value matches to one of the plurality of predetermined certain condition values using the smart gateway, if yes, goes to step c; if not, goes to step b1;

c, extracting the operation command and the unique identification code of the home appliance which is assigned to execute the operation command from the predetermined controlling command corresponding to the predetermined certain condition value which matches to the current certain condition value, by using the smart gateway;

b1, determining whether the current certain condition value matches to one of the plurality of habit certain condition values using the smart gateway, if yes, goes to step cl; if not, goes back to step a;

c1, extracting the operation command and the unique identification code of the home appliance which is assigned to execute the operation command from the habit controlling command corresponding to the habit certain condition value which matches to the current certain condition value, by using the smart gateway;

d, sending a controlling signal including the operation command to the home appliance which is assigned to execute the operation command using the smart gateway; and S31, recording the received controlling command inputted by a user and the corresponding certain condition value detected by the detecting unit as an operation record using the smart gateway;

S32, analyzing a plurality of operation records and determining whether the number of times that a controlling command under a same certain condition value or in a same certain condition value range has reached or is equal to a predetermined number of times within a predetermined time period, if yes, the process goes to step S33, otherwise, goes to end;

S33, determines the controlling command is a habit and the certain condition value or value range is a certain condition value or value range corresponding to the habit, and recording the habit controlling command and the corresponding habit certain condition value or value range in the intelligent command table.

2. A smart gateway applied to a smart home system, the smart gateway communicating with a plurality of home appliances and a detecting unit configured to detecting current certain condition value, the smart gateway comprising:

a storage unit storing an intelligent command table comprising a plurality of predetermined certain condition values and predetermined controlling commands corresponding to the plurality of predetermined certain condition values, a plurality of habit certain condition values and habit controlling commands corresponding to the plurality of habit certain condition values, each of the plurality of predetermined controlling commands and the plurality of habit controlling commands comprising an operation command and an unique identification code of a home appliance which is assigned to execute the operation command;

an intelligent controlling unit configured to firstly determine whether the current certain condition value matches to one of the plurality of predetermined certain condition values and send the predetermined controlling command corresponding to one predetermined certain condition which matches to the current certain condition value when the current certain condition value matches to the predetermined certain condition value, and secondly determine whether the current certain condition value matches to one of the plurality of habit certain condition values when the current certain condition value matches to none of the plurality of predetermined certain condition values and send the habit controlling command corresponding to one habit certain condition which matches to the current certain condition value when the current certain condition value matches to the habit certain condition value;

a processor unit configured to extract the operation command and the unique identification code of the home appliance which is assigned to execute the operation command from the predetermined controlling commands and the habit controlling commands;

a communication unit configured to send a controlling signal comprising the operation command to the home appliance which is assigned to execute the operation command according to the unique identification code of the home appliance; and a learning unit, wherein the learning unit comprises:

a recording module configured to record the received controlling command inputted by a user and the corresponding certain condition value detected by the detecting unit as an operation record; and an analysis module configured to analyze whether the number of times that a controlling command under a same certain condition value or in a same certain condition value range has reached or is equal to a predetermined number of times within a predetermined time period, determine the controlling command is a habit and the certain condition value or value range is a certain condition value or value range corresponding to the habit when the times of the controlling command repeats under a same certain condition value or in a same certain condition value range has reached or are equal to a predetermined number of times within a predetermined time period, and recording the habit controlling command and the corresponding habit certain condition value or value range in the intelligent command table.

3. The smart gateway as described in claim 2, wherein the communication unit is a Power Line Communication modem unit, the Power Line Communication modem unit sends the controlling signal to the home appliance via power line.

4. The smart gateway as described in claim 2, wherein the detecting unit is a component of the smart gateway.

5. The smart gateway as described in claim 2, wherein the detecting unit is a detecting device independent from the smart gateway.

6. The smart gateway as described in claim 2, wherein the detecting unit comprises a timer module, a temperature sensor module, a light sensor module, a noise sensor module, and a humidity sensor module.

7. The smart gateway as described in claim 6, wherein the detecting unit further comprises a microphone configured to capture and convert voice to electronic signals, and send the electronic signals to the smart gateway, the smart gateway configured to recognize the controlling command from voice and control the target home appliance via voice control technology.

8. The smart gateway as described in claim 7, wherein cloud computing technology is employed to recognize the controlling command.

9. The smart gateway as described in claim 2, further comprising a speaker.

10. The smart gateway as described in claim 2, wherein the smart gateway further comprises an Internet communication unit, the smart gateway communicates with an Internet controller and a server via the Internet communication unit, the smart gateway receives the controlling command sent by the Internet controller and the server.

11. The smart gateway as described in claim 2, wherein the communication unit is based on wired or wireless network technology, the wireless network technology is selected from a group consisting of IR, BLUETOOTH, Z-wave, NFC, Zigbee, WIFI or WIPI communication technologies, the wired communication technology is selected from a group consisting of Power Line Communication, Optical Fiber Power Line Communication, Internet communication, coaxial cable communication, and telephone line communication technologies.

12. A smart home system, comprising a plurality of home appliances, a smart gateway connected to the Internet and communicating with a plurality of home appliances, a detecting unit configured to detecting current certain condition value, and an intelligent command table comprising a plurality of predetermined certain condition values and predetermined controlling commands corresponding to the plurality of predetermined certain condition values, a plurality of habit certain condition values and habit controlling commands corresponding to the plurality of habit certain condition values, each of the plurality of predetermined controlling commands and the plurality of habit controlling commands comprising an operation command and an unique identification code of a home appliance which is assigned to execute the operation command; the smart gateway controlling the home appliances to execute a corresponding operation according to a received control command;

the smart gateway comprising:

an intelligent controlling unit configured to firstly determine whether the current certain condition value matches to one of the plurality of predetermined certain condition values and send the predetermined controlling command corresponding to one predetermined certain condition which matches to the current certain condition value when the current certain condition value matches to the predetermined certain condition value, and secondly determine whether the current certain condition value matches to one of the plurality of habit certain condition values when the current certain condition value matches to none of the plurality of predetermined certain condition values and send the habit controlling command corresponding to one habit certain condition which matches to the current certain condition value when the current certain condition value matches to the habit certain condition value;

a processor unit configured to extract the operation command and the unique identification code of the home appliance which is assigned to execute the operation command from the predetermined controlling commands and the habit controlling commands; and a communication unit configured to send a controlling signal comprising the operation command to the home appliance which is assigned to execute the operation command according to the unique identification code of the home appliance;

the home appliance configured for receiving the corresponding controlling signal sent by the smart gateway, and executing the corresponding operation according the operation command included in the controlling signal;

a learning unit, wherein the learning unit comprises:

a recording module configured to record the received controlling command inputted by a user and the corresponding certain condition value detected by the detecting unit as an operation record; and an analysis module configured to analyze whether the number of times that a controlling command under a same certain condition value or in a same certain condition value range has reached or is equal to a predetermined number of times within a predetermined time period, determine the controlling command is a habit and the certain condition value or value range is a certain condition value or value range corresponding to the habit when the times of the controlling command repeats under a same certain condition value or in a same certain condition value range has reached or are equal to a predetermined number of times within a predetermined time period, and recording the habit controlling command and the corresponding habit certain condition value or value range in the intelligent command table.

13. The smart home system as described in claim 12, wherein the detecting unit is a component of the smart gateway.

14. The smart home system as described in claim 12, wherein the detecting unit is a detecting device independent from the smart gateway.

15. The smart home system as described in claim 12, wherein the detecting unit comprises a timer module, a temperature sensor module, a light sensor module, a noise sensor module, and a humidity sensor module.

16. The smart home system as described in claim 15, wherein the detecting unit further comprises a microphone configured to capture and convert voice to electronic signals, and send the electronic signals to the smart gateway, the smart gateway configured to recognize the controlling command from voice and control the target home appliance using voice control technology.

17. The smart home system as described in claim 12, wherein the communication unit is based on wired or wireless network technology, the wireless network technology is selected from a group consisting of IR, BLUETOOTH, Z-wave, NFC, Zigbee, WIFI or WIPI communication technologies, the wired communication technology is selected from a group consisting of Power Line Communication, Optical Fiber Power Line Communication, Internet communication, coaxial cable communication, and telephone line communication technologies.

* * * * *